US007640904B2

(12) United States Patent
Borraccia et al.

(10) Patent No.: US 7,640,904 B2
(45) Date of Patent: Jan. 5, 2010

(54) ROTOR AND STATOR SEALS FOR A VANE-TYPE CAMSHAFT PHASER

(75) Inventors: Dominic Borraccia, Spencerport, NY (US); Natalie G. Payne, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 302 days.

(21) Appl. No.: 11/638,593

(22) Filed: Dec. 13, 2006

(65) Prior Publication Data

US 2008/0141962 A1 Jun. 19, 2008

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 2,790,520 A * 4/1957 Kuhn, Jr. ..... 188/307
2002/0139334 A1* 10/2002 Kinugawa ..... 123/90.17

* cited by examiner

*Primary Examiner*—Zelalem Eshete
(74) *Attorney, Agent, or Firm*—Thomas N. Twomey

(57) ABSTRACT

A vane-type camshaft phaser includes a rotor having a plurality of vanes disposed in a stator having a plurality of lobes, the interspersion of vanes and lobes defining a plurality of alternating valve timing advance and valve timing retard chambers. Each vane and lobe tip is provided with an axially extending groove having an outward expansion of width. A wiper seal element, formed by stamping and folding from a single piece of sheet material, has folded wings that extend under compression into the groove. The spring loading of the wings against the tapered walls of the groove acts to urge the wiper seal element out of the groove and toward the opposing stator or rotor wall, thus ensuring a continuous forced sealing contact of the wiper seal element with the opposing wall and the groove walls during operation of the camshaft phaser.

12 Claims, 3 Drawing Sheets

ROTOR AND STATOR SEALS FOR A VANE-TYPE CAMSHAFT PHASER

TECHNICAL FIELD

The present invention relates to vane-type camshaft phasers for varying the phase relationship between crankshafts and camshafts in internal combustion engines; more particularly, to such phasers wherein a rotor vane and/or a stator lobe includes a compressible radial seal element for wiping the stator wall and/or rotor hub to prevent leakage around the rotor; and most particularly, to a phaser having an improved one-piece compressible wiper seal element disposed in the rotor vanes and/or the stator lobes.

BACKGROUND OF THE INVENTION

Camshaft phasers for varying the phase relationship between the crankshaft and a camshaft of an internal combustion engine are well known. A prior art vane-type phaser generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve (OCV), in accordance with an engine control module, to either the advance or retard chambers as required to meet current or anticipated engine operating conditions.

In a typical prior art vane-type cam phaser, the tip of each rotor vane and stator lobe is provided with a compressible seal element for wiping the cylindrical wall of the opposite member to prevent leakage between the advance and retard chambers.

A first known wiper seal element utilizes a two-piece construction consisting of a plastic wiper blade and backing spring disposed within the vane or lobe to load the wiper blade against the stator or rotor surface.

A second known wiper seal element utilizes a two-piece seal disposed in an axially-extending groove formed in the vane or lobe tip. Typically, an elastomeric spring is overmolded onto a rigid plastic wiper-shaped substrate. This configuration requires two successive manufacturing steps and two different materials to provide a single wiper element, creating undesired manufacturing cost and complexity.

Many prior art wiper configurations also require significant tolerance control on the dimensions of the groove in which the wiper element is disposed. The depth of the groove can affect the spring force on the wiper element, and the width of the groove can affect control of oil leakage behind the wiper element.

What is needed in the art is an improved wiper seal element that is simple and inexpensive to manufacture, is of one-piece construction, is durable, and is self actuating to urge itself continuously against a stator or rotor wall.

What is further needed in the art is an improved wiper seal system that is tolerant of manufacturing variability in the depth and width of a groove in the tip of a rotor vane or stator lobe.

It is a principal object of the present invention to improve the reliability of a wiper seal element in a vane-type camshaft phaser.

It is a further object of the present invention to reduce the manufacturing cost and complexity of a phaser wiper seal element.

It is a still further object of the present invention to reduce the manufacturing cost and complexity of forming a tip groove by relaxing the width and depth tolerances required of the groove to seal the phaser against leakage between the advance and retard chambers.

SUMMARY OF THE INVENTION

Briefly described, a vane-type camshaft phaser in accordance with the invention for varying the timing of combustion valves in an internal combustion engine includes a rotor having a plurality of vanes disposed in a stator having a plurality of lobes, the interspersion of vanes and lobes defining a plurality of alternating valve timing advance and valve timing retard chambers with respect to the engine crankshaft. During rotation of the rotor within the stator, the tips of the vanes sweep past concave cylindrical walls of the stator, and the tips of the lobes sweep past convex cylindrical walls of the rotor hub. Each vane and lobe tip is provided with an axially extending groove having an outward expansion of width. A wiper seal element is disposed in the groove for wiping the opposing wall. The wiper seal element is formed by cutting and folding from a single piece of sheet material, preferably a spring steel, and has folded wings that extend into the groove. The wings must be slightly compressed for the wiper seal element to fit into the groove. The spring loading of the wings against the tapered walls of the groove acts to urge the wiper seal element out of the groove and toward the opposing wall, thus ensuring a continuous forced sealing contact of the wiper seal element with the opposing stator or rotor wall and with the walls of the groove during use of the camshaft phaser.

A system in accordance with the invention thus comprises an improved vane or lobe groove having tapering walls and a folded wiper seal element disposed in the groove.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
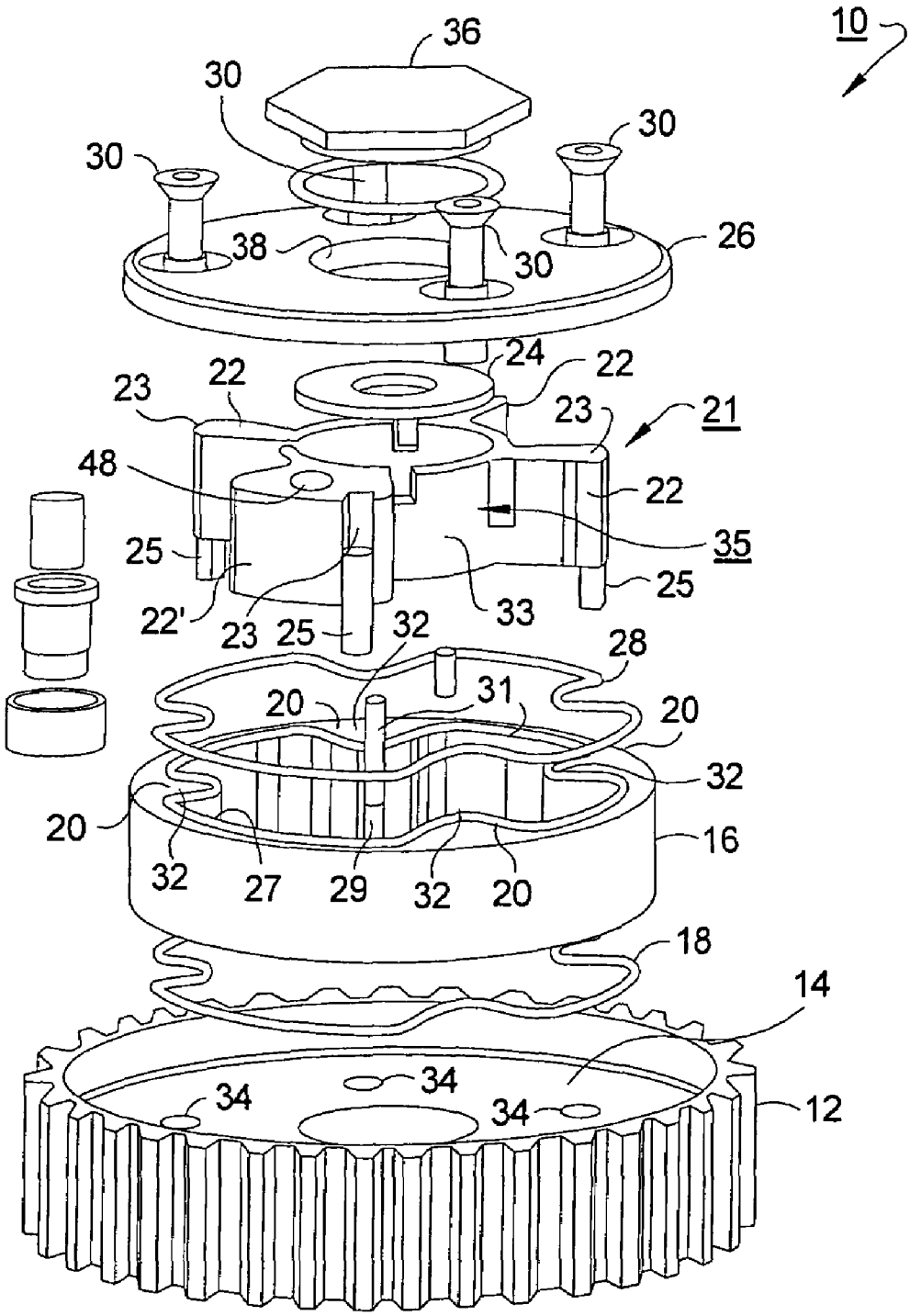
FIG. 1. (PRIOR ART)
FIG. 1 is an exploded isometric view of a typical prior art vane-type camshaft phaser.
Figure 2:
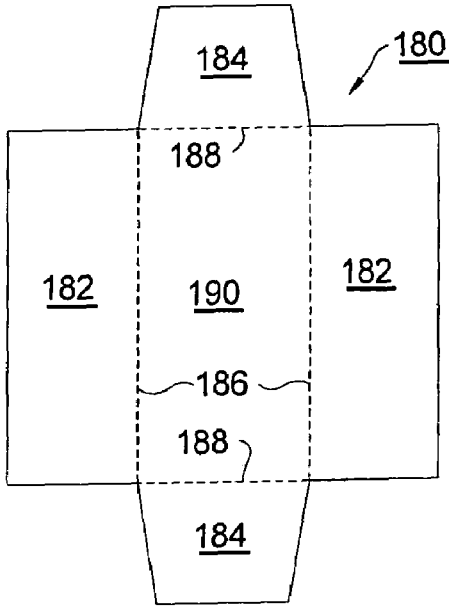
FIG. 2 is a plan view of a planar material blank for forming a wiper seal element in accordance with the present invention, prior to folding thereof.
Figure 3:
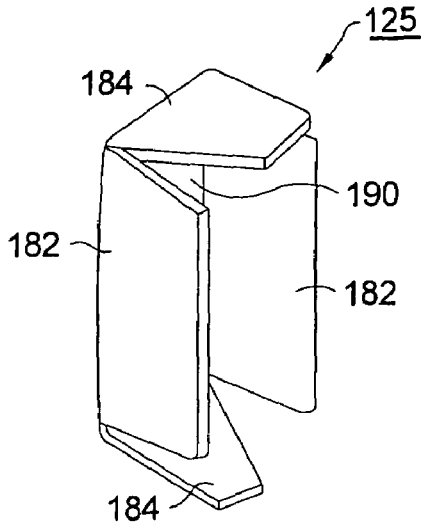
FIG. 3 is an isometric view of a folded wiper seal element in accordance with the invention.
Figure 4:
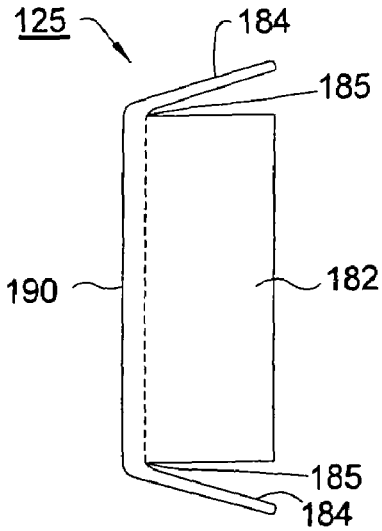
FIG. 4 is a side view of the folded wiper seal element shown in FIG. 3.

Referring to FIG. 1, an exemplary prior art vane-type cam phaser 10 includes a pulley or sprocket 12 for engaging a timing chain or belt (not shown) operated by an engine crankshaft (not shown). The upper surface 14 of pulley/sprocket 12 forms a first wall of a plurality of hydraulic chambers in the assembled phaser. A stator 16 is disposed against surface 14 and is sealed thereto by a first seal ring 18. Stator 16 is rotationally immobilized with respect to pulley/sprocket 12.

Stator 16 is provided with a plurality of inwardly-extending lobes 20 circumferentially spaced apart for receiving a rotor 21 including outwardly extending vanes 22 which extend into the spaces between lobes 20. Hydraulic advance and retard chambers are thus formed between lobes 20 and vanes 22. A thrust washer 24 is concentrically disposed against rotor 21, and cover plate 26 seals against stator 16 via a second seal ring 28. Bolts 30 extend through bores 32 in stator 16 and are received in threaded bores 34 in pulley/sprocket 12, immobilizing the stator with respect to the pulley/sprocket. In installation to an engine camshaft, phaser 10 is secured via a central bolt (not shown) through thrust washer 24 which is covered by cover plug 36 which is threaded into bore 38 in cover plate 26.

Each rotor vane 22 is provided with an axial groove 23 along the vane tip for receiving a resilient seal element 25 for sealingly wiping a cylindrically concave inner wall 27 of stator 16.

Likewise, each stator lobe 20 is provided with an axial groove 29 along the lobe tip for receiving a resilient seal element 31 for sealingly wiping a cylindrically convex outer wall 33 of rotor hub 35.

Referring now to FIGS. 2 through 5, an improved wiper seal element 125 is shown. (It should be recognized that the improved wiper seal element 125 disclosed herein is equally suitable as a direct replacement for either of prior art vane seal 25 or prior art lobe seal element 31 after modification of prior art vane groove 23 and prior art lobe groove 29 in accordance with the invention as described hereinbelow. For convenience, the improved wiper seal element is labeled herein only as the vane seal replacement 125.)

Figure 5:
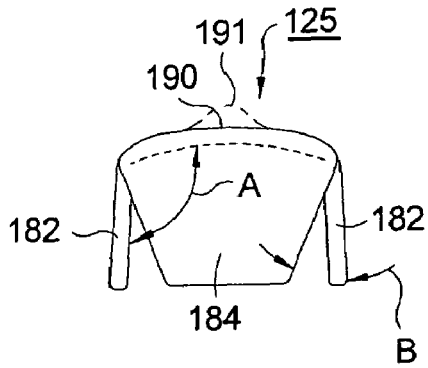
FIG. 5 is an end view of a folded-wiper seal element shown in FIG. 3.

In a currently-preferred method of manufacturing wiper seal element 125, an is element blank 180 is formed as by stamping from sheet stock of an appropriate material, which may be a metal or a plastic, and preferably is a spring stainless steel. Blank 180 includes first and second longitudinal wings 182 defining leaf springs and optionally first and second end wings 184 formable by folding blank 180 along dotted lines 186, 188, respectively, to provide a three-dimensional wiper seal element 125 having wings 182, 184 extending at an angle from a central wiping portion 190. Optionally, a longitudinal central rib 191 may be formed in central wiping portion 190, or portion 190 may be formed as a crown without rib 191, to provide essentially line contact between central wiping portion 190 and an opposing surface to be wiped, thereby reducing contact area. Friction-reducing coatings of central wiping portion 190 and/or central rib 191 are contemplated. Preferably end wings 184 are tapered to approximate the corresponding taper angle 194, 198 (FIGS. 6 and 7) of the vane or lobe groove, described below, into which wiper seal element 125 is to be inserted, thereby helping to control leakage behind wiper seal element 125 or past the end wings 184 thereof. Further, when formed, wiping portion may be drawn away from corners 185 where wings 182, 184 meet, to reduce a potential oil leak path through the open corners. Note that longitudinal wings 182 in their relaxed state are non-resiliently and permanently folded from the plane of central wiping portion 190 by, for example, only about 90° (shown as angle A in FIG. 5). Note also that wings 182 act as leaf springs when compressed inward through angle B (FIG. 5).

Figure 6:
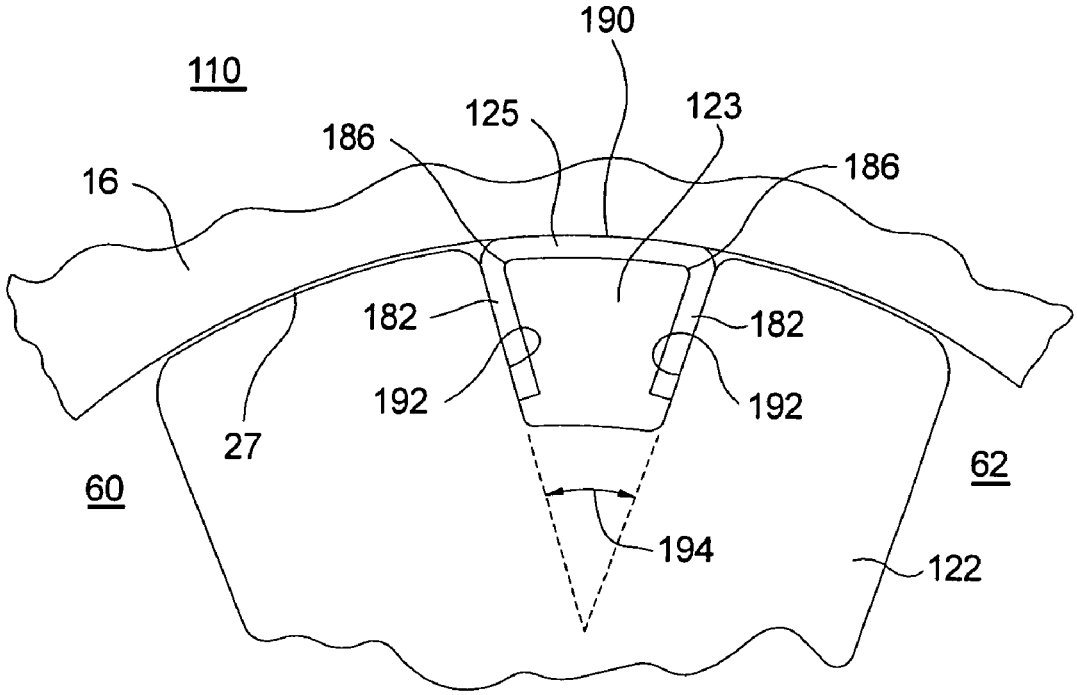
FIG. 6 is a first cross-sectional view of a phaser rotor and stator including the folded wiper seal element shown in FIGS. 3-5 mounted in a rotor vane.

Referring now to FIG. 6, an improved camshaft rotor vane 122 in accordance with the invention includes a vane groove 123 having sides 192 that diverge by an included taper angle 194. Improved wiper seal element 125 is inserted into groove 123 by resiliently compressing wings 182 toward one another along fold lines 186. In such a compressed state, a vector is created urging wings 182 outwards of groove 123 and toward concave inner wall 27 of stator 16 to form a dynamic hydraulic seal of central portion 190 against passage of oil along inner wall 27 between advance and retard chambers 60, 62. Note that the outward pressure of wings 182 against sides 192 effectively seals against leakage of oil around wiper seal element 125.

Figure 7:
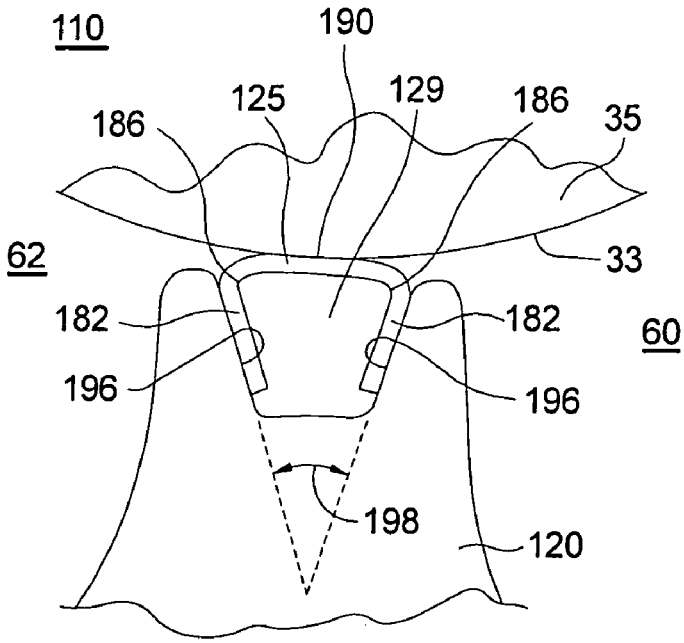
FIG. 7 is a second cross-sectional view of a phaser rotor and stator including the folded wiper seal element shown in FIGS. 3-5 mounted in a stator lobe.

Referring now to FIG. 7, an improved camshaft stator lobe 120 in accordance with the invention includes a lobe groove 129 having sides 196 that diverge by an included taper angle 198 which may be equal to angle 194 (FIG. 6) or not. Improved wiper seal element 125 is inserted into groove 129 by resiliently compressing wings 182 toward one another along fold lines 186. In such a compressed state, a vector is created urging wings 182 outwards of lobe groove 129 and toward convex outer wall surface 33 of rotor hub 35 to form a dynamic hydraulic seal of central portion 190 against passage of oil along outer wall 33 between advance and retard chambers 60, 62. Note that the outward pressure of wings 182 against sides 196 effectively seals against leakage of oil around wiper seal element 125.

Because of the line contact created by the compression of wings 182 into groove 123 or 129, the dimensional accuracy of these grooves is much relaxed over that of prior art grooves 23 and 29, thereby reducing the cost of manufacture of an improved camshaft phaser 110.

In some camshaft phasers, seals are required on only the rotor vanes and are omitted from the stator lobes. Such phasers are fully comprehended by the present invention.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for preventing leakage of oil between advance and retard chambers formed between rotor vanes and stator lobes in a vane-type camshaft phaser, comprising:

a) a longitudinal groove formed in the tip of a first phaser element, said groove having first and second walls divergent outwards of said tip; and b) a wiper seal element extending into said longitudinal groove, said wiper seal element having first and second longitudinal wings compressed between and in continuous contact with said first and second divergent walls, and said wiper seal element having a central portion between said first and second longitudinal wings extending into sealing contact with an opposing wall of a second phaser element in said camshaft phaser.

2. A system in accordance with claim 1 wherein said first phaser element is selected from the group consisting of rotor vane and stator lobe and said second phaser element is selected from the group consisting of stator wall and rotor hub.

3. A system in accordance with claim 1 wherein said wiper seal element is formed by a process including stamping and folding.

4. A system in accordance with claim 1 wherein said wiper seal element is formed of a material selected from the group consisting of metals and plastics.

5. A system in accordance with claim 1 wherein said central portion further comprises a longitudinal rib extending into contact with said opposing wall.

6. A system in accordance with claim 1 wherein said opposing wall of said second phaser element is selected from the group consisting of cylindrical concave stator surface and cylindrical convex rotor hub.

7. A vane-type camshaft phaser for advancing and retarding the timing of valves in an internal combustion engine, comprising:

a) a first element having a longitudinal groove formed in the tip thereof, said groove having first and second walls divergent outwards of said tip; and b) a wiper seal element extending into said longitudinal groove, said wiper seal element having first and second longitudinal wings compressed between and in continuous contact with said first and second divergent walls, and said wiper seal element having a central portion between said first and second longitudinal wings extending into sealing contact with an opposing wall of a second phaser element.

8. A vane-type camshaft phaser, in accordance with claim 7 wherein said first phaser element is selected from the group consisting of rotor vane and stator lobe and said second phaser element is selected from the group consisting of stator wall and rotor hub.

9. An internal combustion engine comprising a camshaft phaser for advancing and retarding the timing of valves, wherein said camshaft phaser includes a first element having a longitudinal groove formed in the tip thereof, said groove having first and second walls divergent outwards of said tip, and a wiper seal element extending into said longitudinal groove, said wiper seal element having first and second longitudinal wings compressed between and in continuous contact with said first and second divergent walls, and said wiper seal element having a central portion between said first and second longitudinal wings extending into sealing contact with an opposing wall of a second phaser element in said camshaft phaser.

10. An internal combustion engine, in accordance with claim 9 wherein said first phaser element is selected from the group consisting of rotor vane and stator lobe and said second phaser element is selected from the group consisting of stator wall and rotor hub.

11. A vane-type camshaft phaser for advancing and retarding the timing of valves in an internal combustion engine, comprising:

a) a rotor having a longitudinal groove formed in the tip of a vane thereof, said groove having first and second walls divergent outwards of said tip; and b) a wiper seal element extending into said longitudinal groove, said wiper seal element having first and second longitudinal wings compressed between and in continuous contact with said first and second divergent walls, and said wiper seal element having a central portion between said first and second longitudinal wings extending into sealing contact with a cylindrical concave wall of a stator.

12. A system for preventing leakage of oil between advance and retard chambers formed between rotor vanes and stator lobes in a vane-type camshaft phaser, comprising:

a) a longitudinal groove formed in the tip of a first phaser element, said groove having first and second walls divergent outwards of said tip; and b) a wiper seal element extending into said longitudinal groove, said wiper seal element having first and second longitudinal wings compressed between and in continuous contact with said first and second divergent walls, and said wiper seal element having a central portion between said first and second longitudinal wings, wherein said first and second longitudinal wings compressed between said first and second divergent walls urge said wiper seal element into sealing contact with an opposing wall of a second phaser element in said camshaft phaser.

* * * * *